US007871313B2

(12) United States Patent
Roehm et al.

(10) Patent No.: US 7,871,313 B2
(45) Date of Patent: Jan. 18, 2011

(54) HAND-GUIDED MACHINE TOOL

(75) Inventors: Heiko Roehm, Stuttgart (DE); Andreas Heber, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 183 days.

(21) Appl. No.: 12/296,947

(22) PCT Filed: Nov. 15, 2007

(86) PCT No.: PCT/EP2007/062368

§ 371 (c)(1),
(2), (4) Date: Oct. 13, 2008

(87) PCT Pub. No.: WO2008/080688

PCT Pub. Date: Jul. 10, 2008

(65) Prior Publication Data

US 2009/0280728 A1 Nov. 12, 2009

(30) Foreign Application Priority Data

Dec. 27, 2006 (DE) ..... 10 2006 061 635

(51) Int. Cl.
*B24B 55/04* (2006.01)

(52) U.S. Cl. ..... 451/456; 451/357; 451/359; 451/453

(58) Field of Classification Search ..... 451/354, 451/356, 357, 359, 451, 453, 456
See application file for complete search history.

(56) References Cited

U.S. PATENT DOCUMENTS

| | | | | |
|---|---|---|---|---|
| 5,993,305 | A * | 11/1999 | Chu | 451/357 |
| 6,027,399 | A * | 2/2000 | Stewart | 451/353 |
| 6,447,387 | B1 * | 9/2002 | Tseng | 451/456 |
| 6,910,960 | B2 * | 6/2005 | Reich et al. | 451/451 |
| 7,553,217 | B2 * | 6/2009 | Reich et al. | 451/344 |
| 2005/0202767 | A1 | 9/2005 | Reich et al. | |
| 2009/0298403 | A1 * | 12/2009 | Yamashiro et al. | 451/453 |

FOREIGN PATENT DOCUMENTS

| | | |
|---|---|---|
| DE | 10 2005 014 045 | 9/2006 |
| EP | 1 506 840 | 2/2005 |
| WO | 2004/039539 | 5/2004 |

* cited by examiner

*Primary Examiner*—Eileen P. Morgan
(74) *Attorney, Agent, or Firm*—Michael J. Striker

(57) ABSTRACT

A hand-held machine tool has an electric drive motor (3), arranged in a housing (2), for driving a tool (5), wherein a dust collecting container (7) is connected to the housing and has in its wall a container connector (8), which can be pushed axially onto a blow-out connector (6) in the housing. When the connection is disconnected, the wall (11) of the dust collecting container and an assigned wall (15) on the housing are in contact by way of at least one common supporting point, wherein the supporting point is displaced in the axial direction when the dust collecting container rotates about a longitudinal axis (9) of the container connector.

8 Claims, 2 Drawing Sheets

HAND-GUIDED MACHINE TOOL

Figure 1:
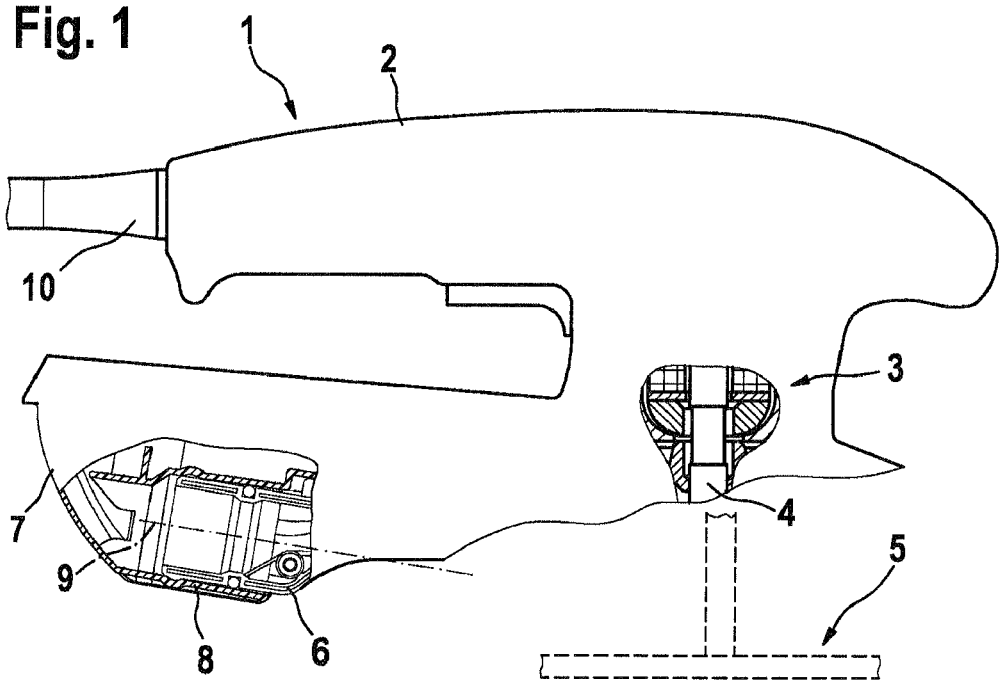

The present invention relates to a hand-guided machine tool, in particular a grinder, according to the preamble of claim 1.

BACKGROUND INFORMATION

DE 10 2005 014 045 A1 describes a hand-guided grinder, which includes—on the underside of the housing—a grinding plate with suction holes for suctioning up dust. An abrasive disc in which holes that correspond with the suction holes have been punched is installed on the grinding plate. With the aid of a dust fan, the grinding dust produced during operation of the grinder is directed through the holes in the abrasive disc, and it is directed further via the holes in the grinding plate and via a blow-out connector on the housing and into a dust collection container, which has been installed on the blow-out connector. To empty the dust collection container, it is pulled off of the blow-out connector in the axial direction opposite to that in which it is installed. The dust collection container is typically sealed off from the surroundings via a sealing ring located on the blow-out connector. When the dust collection container is removed, the problem may occur that, due to the increased friction between the sealing ring and the dust collection container, a considerable resistance must be overcome in order to detach the dust collection container from the blow-out connector. Once the initial high resistance is overcome, the dust collection container is abruptly released.

DISCLOSURE OF THE INVENTION

The object of the present invention is to design a hand-guided machine tool using simple design measures such that the dust collection container may be removed from the machine tool in a controlled manner.

This object is achieved according to the present invention via the features of claim 1.

The subclaims describe advantageous refinements.

The hand-guided machine tool according to the present invention includes an electric motor in a housing for driving a tool, via which a work piece will be worked. A dust collection container for receiving abraded particles, e.g., grinding dust, may be connected with the housing by sliding a container connector—which is installed in the wall of the dust collection container—onto an associated blow-out connector on the housing of the machine tool in the axial direction. In the installed position, the container connector and the blow-out connector are located coaxially with one another.

To release this connection, it is provided according to the present invention that the wall of the dust collection container and an associated wall of the housing are in contact with each other via at least one common support point that has radial clearance from the longitudinal axis. When the dust collection container is rotated about the longitudinal axis of the container connector, the support point travels in the axial direction—relative to the longitudinal axis of the container connector—and, expediently, in the circumferential direction as well. This superposed rotary and axial motion of the contact point represents a combination of a rotary and translational displacement motion, with the translational components pointing in the axial direction of the container connector of the dust collection container. This axial motion of the contact point serves as the actuating motion for the axial release motion of the dust collection container, which bears via the support point against the wall of the housing.

The trajectory of the contact point follows an approximately spiral path. An axial displacement in the release direction of the container is therefore automatically attained when the dust collection container is rotated around the axis of the container connector. It is therefore no longer necessary to apply a manual, axial release force to the dust collection container. Instead, it is sufficient to simply rotate the dust container manually around the axis of the container connector. The axial displacement automatically results via the traveling contact point between the walls of the dust collection container and the housing of the machine tool.

According to an advantageous refinement of the present invention, it is provided that at least one of the walls—which face each other—of the dust collection container and the housing has a shape that deviates from a plane that is vertical relative to the longitudinal axis of the container connector. This wall, which is located either on the dust collection container or the housing or on both components, may itself be flat in design, or it may have a shape that deviates from a plane, e.g., it may be designed as a three-dimensional flank. It is essential that at least one part of this wall is designed to extend vertically—at an angle to the plane—through the longitudinal axis of the container connector; the contact point between the dust collection container and the housing travels along this part of the wall while the container is being detached. Due to the oblique orientation of this part of the wall, the contact point performs a motion with axial components during the release motion that is responsible for the axial removal of the dust collection container of the blow-out connector.

In the installed position, there is—expediently—at least one support point between the housing walls—which face each other—of the machine tool housing and the dust collection container. It is also possible, however, to design corresponding walls to bear against each other in two dimensions, at least in sections, when the dust collection container is in the installed position. In this design, therefore, there is—at least in the installed position—not just a contact point, but also a contact surface. As the rotational motion of the dust collection container about the longitudinal axis of the container connector begins, the two-dimensional contact is eliminated and is reduced to one contact point.

According to a further expedient embodiment, at least one of the connectors—either the container connector on the dust collection container or the blow-out connector on the housing—is slightly conical in design, while the particular other connector is, expediently, cylindrical in design. As the sliding-on motion takes place, the frictional force caused by the seal therefore increases.

It may also be expedient to provide a raised area on the jacket surface of a connector, which, in the installed position, extends into an assigned detent groove in the particular other connector. In this manner, a detent connection is provided that is form-fit in the axial direction, which holds the dust collection container in the installed position on the housing under normal operating conditions despite the vibrations caused by the motor or that occur while the workpiece is being worked. Due to the inherent elasticity of the connectors and/or the detent elements, the detent connection may be automatically released as soon as the dust collection container is rotated about the longitudinal axis of the container connector.

Further advantages and advantageous embodiments are depicted in the further claims, the description of the figures, and the drawing.

Figure 2:
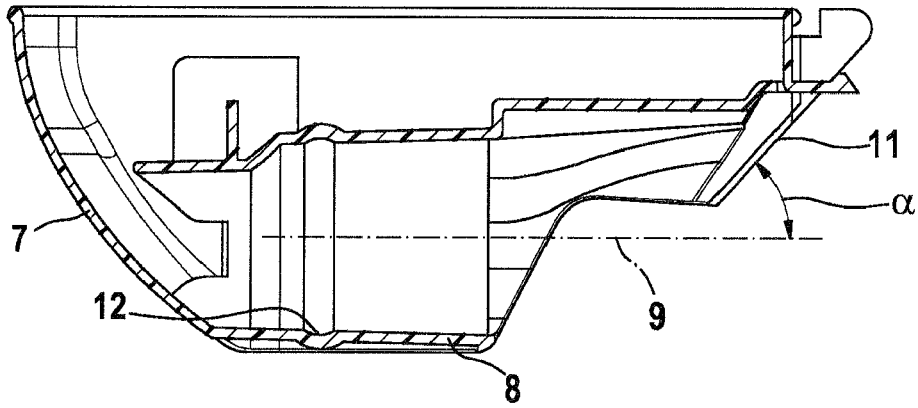
Figure 3:
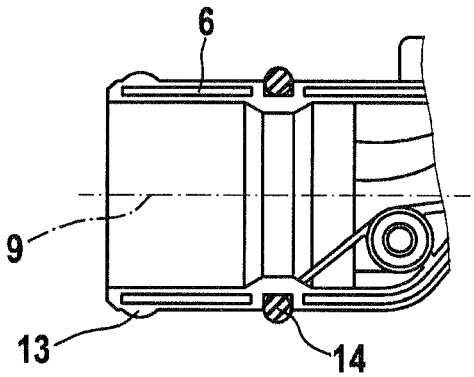
Figure 4:
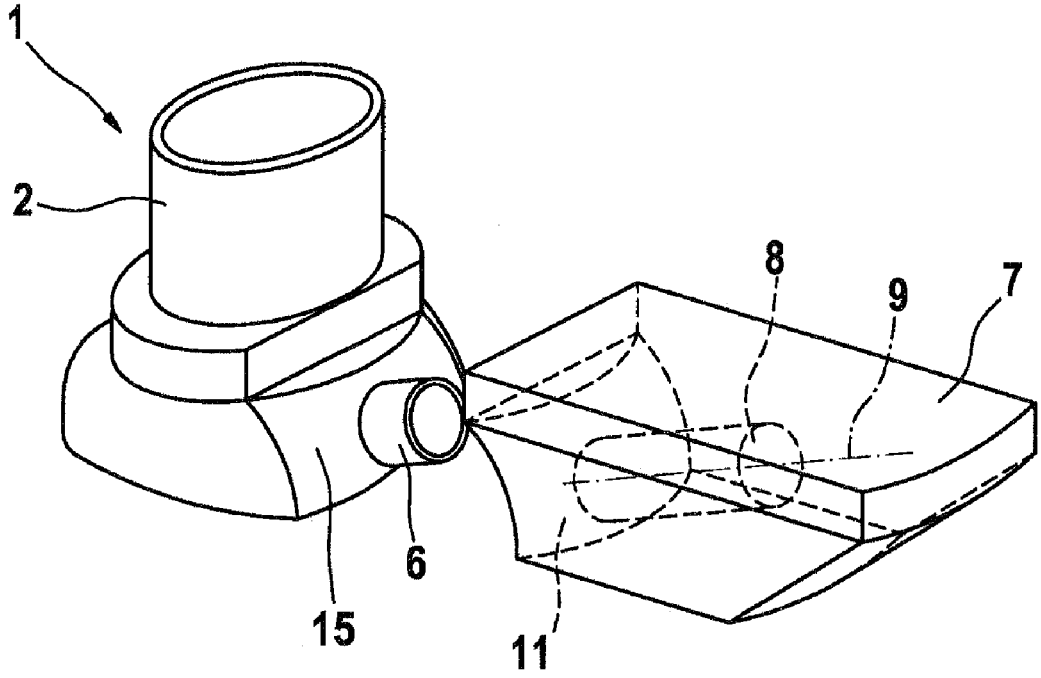

FIG. 1 shows a cross section through a machine tool designed as a finishing sander or an eccentric grinder, on the housing of which a dust collection container is attached, the dust collection container being provided with a container connector that may be slid onto a blow-out connector on the housing, FIG. 2 shows a cross section through the dust collection container with a depiction of the slightly conical container connector and a wall that extends obliquely relative to the longitudinal axis of the container connector, FIG. 3 shows a cross section of the blow-out connector, which is designed as a single piece with the wall of the housing of the machine tool, FIG. 4 shows a schematic, perspective view of a machine tool with a blow-out connector on the housing, onto which the dust collection container may be slid.

Components that are the same are labelled with the same reference numerals in the figures.

Machine tool 1 shown in FIG. 1 is a finishing sander or an eccentric grinder. Other hand-guided, electrically driven machine tools with which abraded particles are produced and captured in a dust collection container may also be considered within the framework of the present invention.

Machine tool 1 includes—in a housing 2 composed of plastic—an electric drive motor 3, which drives a drive shaft 4, which is eccentrically connected with a tool 5. A power-supply connection 10 is provided to supply power to electric drive motor 3. The abraded particles produced when a work-piece is worked—in particular the grinding dust—are suctioned up, e.g., with the aid of a dust fan, which is located in the machine tool, and they are conveyed into the interior of housing 2. From there, the abraded particles travel through a blow-out connector 6, which is designed as a single piece with housing 2, into dust collection container 7. Dust collection container 7—which is advantageously also composed of plastic and into which a filter element, e.g., a paper filter or a polymer filter, may be inserted—includes a container connector 8, which is designed as a single piece with the wall of dust collection container 7. Container connector 8 is slid axially onto blow-out connector 6 of housing 2. In the installed position shown in FIG. 1, container connector 8 and the blow-out connector share a common longitudinal axis 9.

As shown in the enlarged depiction of dust collection container 7 in FIG. 2, an outer, obliquely positioned support wall 11 is formed on the wall of the dust collection container, adjacent to the opening of container connector 8, support wall 11 being flat in design and forming an angle $\alpha$ with longitudinal axis 9 of container connector 8 that is not 90°. In the exemplary embodiment, angle $\alpha$ is approximately 45° to 50°. Support wall 11 corresponds with an assigned support wall 15 (FIG. 4) on the housing of the machine tool, and, in such a manner, in fact, that the assigned support walls bear against each other in two dimensions when dust collection container 7 is in the installed position. Due to the angle $\alpha$, which is not 90° in this case, and therefore deviates from a plane that is perpendicular to longitudinal axis 9, when dust collection container 7 is rotated about longitudinal axis 9 of container connector 8, an axial displacement motion is realized that is generated in this manner: when the rotational motion begins, a contact point between assigned support walls 11 and 15 travels along basically any trajectory that has radial clearance from longitudinal axis 9. In combination with the oblique positioning of the support walls, this results in an axial displacement of dust collection container 7 from the installed position into the released position, in which it has been pulled off of the blow-out connector.

As also shown in FIG. 2, a circumferential detent groove 12 is formed in the inner wall of container connector 8. In the connected state, raised areas 13 shown in FIG. 3 engage in detent groove 12. Raised areas 13 are located on the outside of blow-out connector 6 and are annular in design. As a result, a detent connection between container connector 8 and blow-out connector 6 is realized, which withstands the loads that occur during normal operation of the machine tool and securely holds dust collection container 7 on the housing of the machine tool. FIG. 2 also shows that a circumferential sealing ring 14 is located on the outer jacket surface of blow-out connector 6, which, in the installed state, bears in a sealing manner against the inner side of container connector 8 and helps to prevent undesired airflow.

FIG. 4 shows a machine tool in a variant in which the contact surfaces—which face each other—on support walls 11 and 15 are designed spherical and/or three-dimensional in shape. The two support walls 11 and 15 on the walls of dust collection container 7 and/or housing 2 are designed to correspond with each other, so that, in the installed state, support walls 11 and 15 bear against each other in two dimensions. Due to the three-dimensional shape of the support walls, when dust collection container 7 is rotated around longitudinal axis 9 of container connector 8, at least one contact or support point on support wall 11 moves along support wall 15. The three-dimensional shape of support wall 15 ensures that the support point performs an axial actuating or displacement motion of dust collection container 7 during the rotational motion, so that the dust collection container moves away from housing 2 of machine tool 1 axially, in the direction of longitudinal axis 9 of container connector 8.

What is claimed is:

1. A hand-guided machine tool, in particular a grinder such as an eccentric grinder or a finishing sander, having a drive motor (3) located in a housing (2) for driving a tool (5) that works a work piece, with which a dust collection container (7), releasably connected with the housing (2), is provided to capture abraded particles;

a container connector (8) is installed in a wall (11) of the dust collection container (7), which is slid axially onto an ejection connector (6), installed in a wall (15) in the housing (2), so that, in a connected position, the container connector (8) and the ejection connector (6) have a common longitudinal axis (9), wherein at least one of the walls (11, 15), which face each other, has a shape that deviates from a plane that is vertical relative to the longitudinal axis (9), and wherein, to release the dust collection container (7), the wall (11) of the dust collection container (7) and the wall (15) of the housing (2) are in contact at least one common support point, which has radial clearance from the longitudinal axis (9), such that when the dust collection container (7) is rotated about the longitudinal axis (9), the support point between the dust collection container (7) and the housing (2) is displaced in the axial direction relative to the longitudinal axis (9) of the container connector (8) as the wall (11) and therefore the dust collection container (7) is compelled by its contact at the at least one common support point along a course of said shape deviation following said rotational movement.

2. The machine tool as recited in claim 1, wherein the support point is also displaced in the circumferential direction.

3. The machine tool as recited in one of the claim 1, wherein, in the installed position, a support point on the dust collection container (7) is in contact with a support point on the housing (2).

4. The machine tool as recited in claim 3, wherein, in the installed position, the walls (11, 15)—which face each other—of the dust collection container (7) and the housing (2) bear against each other in two dimensions, at least in sections.

5. The machine tool as recited in claim 1, wherein one of the connectors (6, 8) is conical in design.

6. The machine tool as recited in claim 1, wherein a raised area (13) is located on the jacket surface of a connector (6), which, in the installed position, extends into an assigned detent groove (12) in the other connector (8).

7. The machine tool as recited in claim 1, wherein a sealing ring (14) is located between the container connector (8) and the blow-out connector (6).

8. The machine tool as recited in claim 1, wherein a filter element may be inserted into the dust collection container (7).

* * * * *